US009091173B2

(12) United States Patent
Mosley et al.

(10) Patent No.: US 9,091,173 B2
(45) Date of Patent: Jul. 28, 2015

(54) TURBINE COOLANT SUPPLY SYSTEM

(75) Inventors: John H. Mosley, Portland, CT (US); Ioannis Alvanos, West Springfield, MA (US); Phililp S. Stripinis, Rocky Hill, CT (US); Douglas Paul Freiberg, Glastonbury, CT (US); Hector M. Pinero, Middletown, CT (US); John J. O'Connor, South Windsor, CT (US); Jon Pietrobon, Longueuil (CA)

(73) Assignee: United Technologies Corporation, Hartford, CT (US)

( * ) Notice: Subject to any disclaimer, the term of this patent is extended or adjusted under 35 U.S.C. 154(b) by 493 days.

(21) Appl. No.: 13/485,579

(22) Filed: May 31, 2012

(65) Prior Publication Data

US 2013/0323010 A1 Dec. 5, 2013

(51) Int. Cl.
*F01D 5/08* (2006.01)
*F01D 25/12* (2006.01)

(52) U.S. Cl.
CPC ..... *F01D 5/082* (2013.01); *F01D 25/12* (2013.01)

(58) Field of Classification Search
CPC ..... F01D 25/08; F01D 25/12; F01D 5/081; F01D 5/082; F01D 5/085
USPC ..... 415/115, 116, 120
See application file for complete search history.

(56) References Cited

U.S. PATENT DOCUMENTS 3,085,400 A 4/1963 Sonder et al.
3,632,221 A 1/1972 Uehling
3,945,758 A 3/1976 Lee
4,231,704 A 11/1980 Ayache et al.
4,236,869 A 12/1980 Laurello
4,292,008 A 9/1981 Grosjean et al.
4,425,079 A 1/1984 Speak et al.
4,522,562 A 6/1985 Glowacki et al.
4,653,984 A 3/1987 Robbins
4,664,599 A 5/1987 Robbins et al.
4,709,546 A 12/1987 Weiler
4,759,688 A 7/1988 Wright et al.
4,791,784 A 12/1988 Minardi et al.
4,820,116 A 4/1989 Hovan et al.
4,882,902 A 11/1989 Reigel et al.
4,901,520 A 2/1990 Kozak et al.

(Continued)

FOREIGN PATENT DOCUMENTS

EP 1533473 5/2005

OTHER PUBLICATIONS

International Search Report and Written Opinion, mailed Sep. 6, 2013.

*Primary Examiner* — Dwayne J White
*Assistant Examiner* — William Grigos
(74) *Attorney, Agent, or Firm* — Kinney & Lange, P.A.

(57) ABSTRACT

A gas turbine engine configured to rotate in a circumferential direction about an axis extending through a center of the gas turbine engine comprises a turbine stage. The turbine stage comprises a disk, a plurality of blades and a mini-disk. The disk comprises an outer diameter edge having slots, an inner diameter bore surrounding the axis, a forward face, and an aft face. The plurality of blades is coupled to the slots. The mini-disk is coupled to the aft face of the rotor to define a cooling plenum therebetween in order to direct cooling air to the slots. In one embodiment of the invention, the cooling plenum is connected to a radially inner compressor bleed air inlet through all rotating components so that cooling air passes against the inner diameter bore.

17 Claims, 3 Drawing Sheets

(56) References Cited

U.S. PATENT DOCUMENTS

| | | | | |
|---|---|---|---|---|
| 5,003,773 | A | 4/1991 | Beckwith | |
| 5,131,814 | A | 7/1992 | Przytulski et al. | |
| 5,275,534 | A * | 1/1994 | Cameron et al. | 416/95 |
| 5,310,319 | A | 5/1994 | Grant et al. | |
| 5,327,719 | A | 7/1994 | Mazeaud et al. | |
| 5,555,721 | A | 9/1996 | Bourneuf et al. | |
| 5,562,404 | A | 10/1996 | Koff et al. | |
| 5,575,616 | A | 11/1996 | Hagle et al. | |
| 5,700,130 | A | 12/1997 | Barbot et al. | |
| 5,755,556 | A | 5/1998 | Hultgren et al. | |
| 5,996,331 | A | 12/1999 | Palmer | |
| 6,053,700 | A | 4/2000 | Fosdick | |
| 6,183,193 | B1 | 2/2001 | Glasspoole et al. | |
| 6,227,801 | B1 | 5/2001 | Liu | |
| 6,231,303 | B1 | 5/2001 | Tiemann et al. | |
| 6,331,097 | B1 | 12/2001 | Jendrix | |
| 6,468,032 | B2 | 10/2002 | Patel | |
| 6,540,477 | B2 | 4/2003 | Glynn et al. | |
| 6,547,518 | B1 | 4/2003 | Czachor et al. | |
| 6,551,056 | B2 | 4/2003 | Rau | |
| 6,585,482 | B1 | 7/2003 | Liotta et al. | |
| 6,612,114 | B1 | 9/2003 | Klingels | |
| 6,647,730 | B2 | 11/2003 | Liu | |
| 6,735,956 | B2 | 5/2004 | Romani | |
| 6,749,400 | B2 | 6/2004 | Dougherty et al. | |
| 6,773,225 | B2 | 8/2004 | Yuri et al. | |
| 6,787,947 | B2 | 9/2004 | Coulon et al. | |
| 6,857,851 | B2 * | 2/2005 | Avignon et al. | 415/116 |
| 6,908,278 | B2 * | 6/2005 | Brunet et al. | 415/115 |
| 6,916,151 | B2 * | 7/2005 | Judet et al. | 415/115 |
| 6,945,749 | B2 | 9/2005 | DeCardenas | |
| 7,036,320 | B2 | 5/2006 | Coulon et al. | |
| 7,192,245 | B2 | 3/2007 | Djeridane et al. | |
| 7,195,453 | B2 | 3/2007 | Martin et al. | |
| 7,354,241 | B2 | 4/2008 | Djeridane et al. | |
| 7,383,686 | B2 * | 6/2008 | Aycock et al. | 60/782 |
| 7,458,766 | B2 | 12/2008 | Dailey et al. | |
| 7,552,590 | B2 * | 6/2009 | Drevs et al. | 60/785 |
| 7,658,063 | B1 | 2/2010 | Matheny | |
| 7,690,896 | B2 | 4/2010 | Stevens et al. | |
| 7,708,519 | B2 * | 5/2010 | Mignano | 415/157 |
| 7,743,613 | B2 | 6/2010 | Lee et al. | |
| 7,870,742 | B2 | 1/2011 | Lee et al. | |
| 2002/0067987 | A1 | 6/2002 | Toborg et al. | |
| 2006/0285968 | A1 | 12/2006 | Riahi et al. | |
| 2009/0110561 | A1 * | 4/2009 | Ramerth et al. | 416/96 R |
| 2009/0169370 | A1 | 7/2009 | Morgan et al. | |
| 2009/0282834 | A1 * | 11/2009 | Hein | 60/772 |
| 2010/0124495 | A1 * | 5/2010 | Bifulco | 415/216.1 |
| 2011/0243749 | A1 | 10/2011 | Praisner et al. | |

* cited by examiner

TURBINE COOLANT SUPPLY SYSTEM

BACKGROUND

The present invention relates generally to coolant supply systems in gas turbine engines and more specifically to cooling circuits between compressors and turbine blades.

Gas turbine engines operate by passing a volume of high energy gases through a plurality of stages of vanes and blades, each having an airfoil, in order to drive turbines to produce rotational shaft power. The shaft power is used to drive a compressor to provide compressed air to a combustion process to generate the high energy gases. Additionally, the shaft power is used to drive a generator for producing electricity, or to drive a fan for producing high momentum gases for producing thrust. In order to produce gases having sufficient energy to drive the compressor, generator and fan, it is necessary to combust the fuel at elevated temperatures and to compress the air to elevated pressures, which also increases its temperature. Thus, the vanes and blades are subjected to extremely high temperatures, often times exceeding the melting point of the alloys comprising the airfoils. High pressure turbine blades are subject to particularly high temperatures.

In order to maintain gas turbine engine turbine blades at temperatures below their melting point, it is necessary to, among other things, cool the blades with a supply of relatively cooler air, typically bled from the high pressure compressor. The cooling air is directed into the blade to provide impingement and film cooling. For example, cooling air is passed into interior cooling channels of the airfoil to remove heat from the alloy, and subsequently discharged through cooling holes to pass over the outer surface of the airfoil to prevent the hot gases from contacting the vane or blade directly. Various cooling air channels and hole patterns have been developed to ensure sufficient cooling of various portions of the turbine blade.

A typical turbine blade is connected at its inner diameter ends to a rotor, which is connected to a shaft that rotates within the engine as the blades interact with the gas flow. The rotor typically comprises a disk having a plurality of axial retention slots that receive mating root portions of the blades to prevent radial dislodgment. The siphoned compressor bleed air is typically routed from the compressor to the turbine blade retention slots for routing into the interior cooling channels of the airfoil. As such, the bleed air must pass through rotating and non-rotating components between the high pressure compressor and high pressure turbine. For example, cooling air is often drawn from the radial outer ends of the high pressure compressor vanes and routed radially inward through a support strut to the high pressure shaft before being directed radially outward for flow across the turbine rotor and into the turbine blade roots. Routing of the cooling air in such a manner incurs aerodynamic losses that reduce the cooling effectiveness of the air and overall gas turbine engine efficiency. Additionally, the bleed air must also pass through high pressure zones within the engine that exceed pressures needed to cool the turbine blades. There is, therefore, a continuing need to improve aerodynamic efficiencies in routing cooling fluid within cooling systems of gas turbine engines.

SUMMARY

The present invention is directed toward a turbine stage for use in a gas turbine engine configured to rotate in a circumferential direction about an axis extending through a center of the gas turbine engine. The turbine stage comprises a disk, a plurality of blades and a mini-disk. The disk comprises an outer diameter edge having slots, an inner diameter bore surrounding the axis, a forward face, and an aft face. The plurality of blades is coupled to the slots. The mini-disk is coupled to the aft face of the rotor to define a cooling plenum therebetween in order to direct cooling air to the slots. In one embodiment of the invention, the cooling plenum is connected to a radially inner compressor bleed air inlet through all rotating components so that cooling air passes against the inner diameter bore.

DETAILED DESCRIPTION

Figure 1:
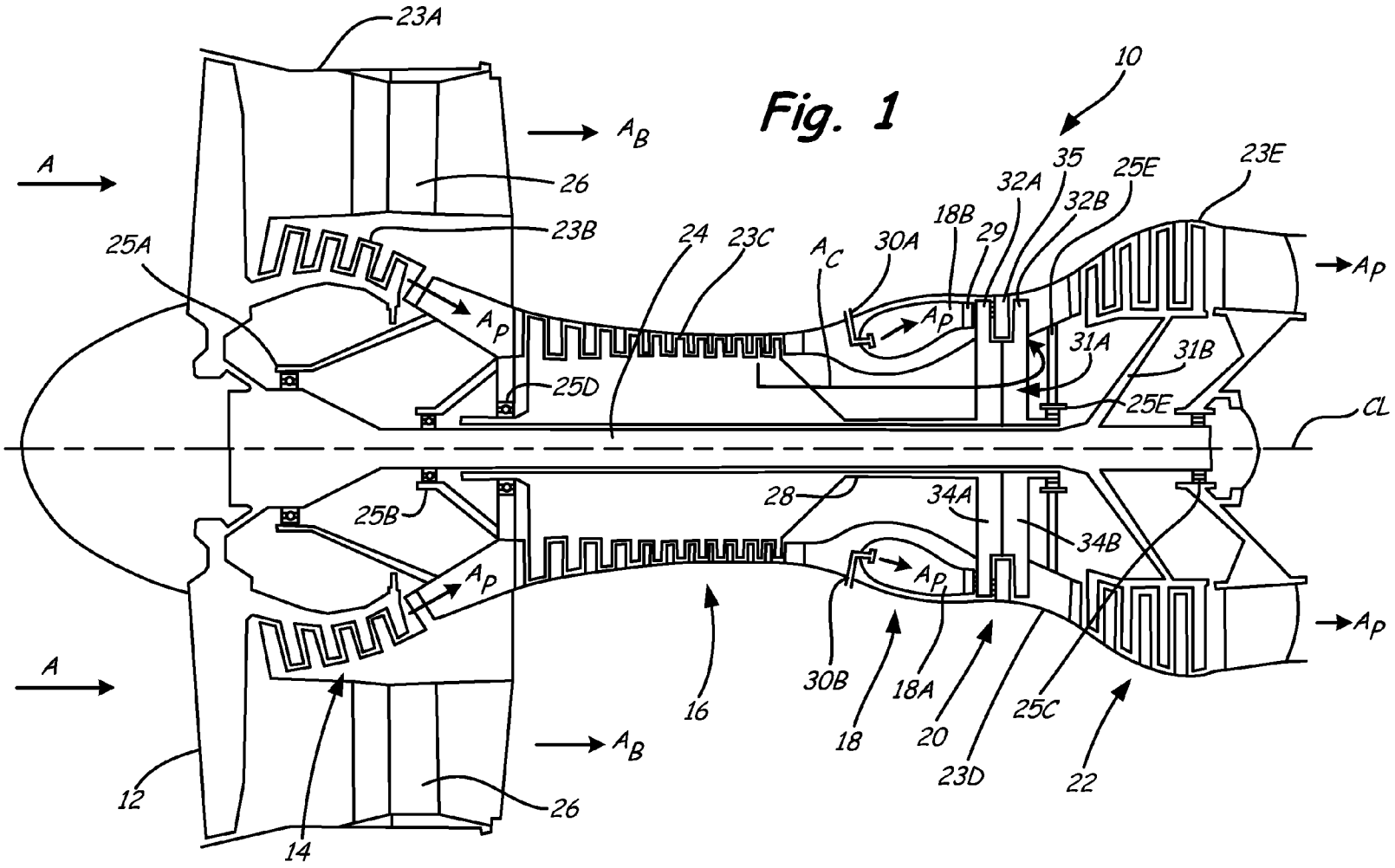
FIG. 1 shows a gas turbine engine including a high pressure compressor section and a high pressure turbine section having the coolant supply system of the present invention.

FIG. 1 shows gas turbine engine 10, in which the coolant supply system of the present invention can be used. Gas turbine engine 10 comprises a dual-spool turbofan engine having fan 12, low pressure compressor (LPC) 14, high pressure compressor (HPC) 16, combustor section 18, high pressure turbine (HPT) 20 and low pressure turbine (LPT) 22, which are each concentrically disposed around longitudinal engine centerline CL. Fan 12 is enclosed at its outer diameter within fan case 23A. Likewise, the other engine components are correspondingly enclosed at their outer diameters within various engine casings, including LPC case 23B, HPC case 23C, HPT case 23D and LPT case 23E such that an air flow path is formed around centerline CL. Although depicted as a dual-spool turbofan engine in the disclosed non-limiting embodiment, it should be understood that the concepts described herein are not limited to use with turbofans as the teachings may be applied to other types of turbine engines, such as three-spool turbine engines and geared fan turbine engines.

Inlet air A enters engine 10 and it is divided into streams of primary air $A_P$ and bypass air $A_B$ after it passes through fan 12. Fan 12 is rotated by low pressure turbine 22 through shaft 24 to accelerate bypass air $A_B$ through exit guide vanes 26, thereby producing a major portion of the thrust output of engine 10. Shaft 24 is supported within engine 10 at ball bearing 25A, roller bearing 25B and roller bearing 25C. Low pressure compressor (LPC) 14 is also driven by shaft 24. Primary air $A_P$ (also known as gas path air) is directed first into LPC 14 and then into high pressure compressor (HPC) 16. LPC 14 and HPC 16 work together to incrementally step-up the pressure of primary air A. HPC 16 is rotated by HPT 20 through shaft 28 to provide compressed air to combustor section 18. Shaft 28 is supported within engine 10 at ball bearing 25D and roller bearing 25E. The compressed air is delivered to combustors 18A and 18B, along with fuel through injectors 30A and 30B, such that a combustion process can be carried out to produce the high energy gases necessary to turn turbines 20 and 22, as is known in the art.

Primary air $A_P$ continues through gas turbine engine 10 whereby it is typically passed through an exhaust nozzle to further produce thrust.

HPT 20 and LPT 22 each include a circumferential array of blades extending radially from rotors 34A and 34B connected to shafts 28 and 24, respectively. Similarly, HPT 20 and LPT 22 each include a circumferential array of vanes extending radially from HPT case 23D and LPT case 23E, respectively. In this specific example, HPT 20 comprises a two-stage turbine, which includes inlet guide vanes 29 having blades 32A and 32B extending from rotor disks 34A and 34B of rotor 34, and vanes 35, which extend radially inward from case HPT case 23E between blades 32A and 32B. Blades 32A and 32B include internal channels or passages into which compressed cooling air $A_C$ air from, for example, HPC 16 is directed to provide cooling relative to the hot combustion gasses of primary air $A_P$. Blades 32B include internal passages into which compressed cooling air $A_C$ from, for example, HPC 16 is routed to provide cooling relative to the hot combustion gasses of primary air A.

Figure 3:
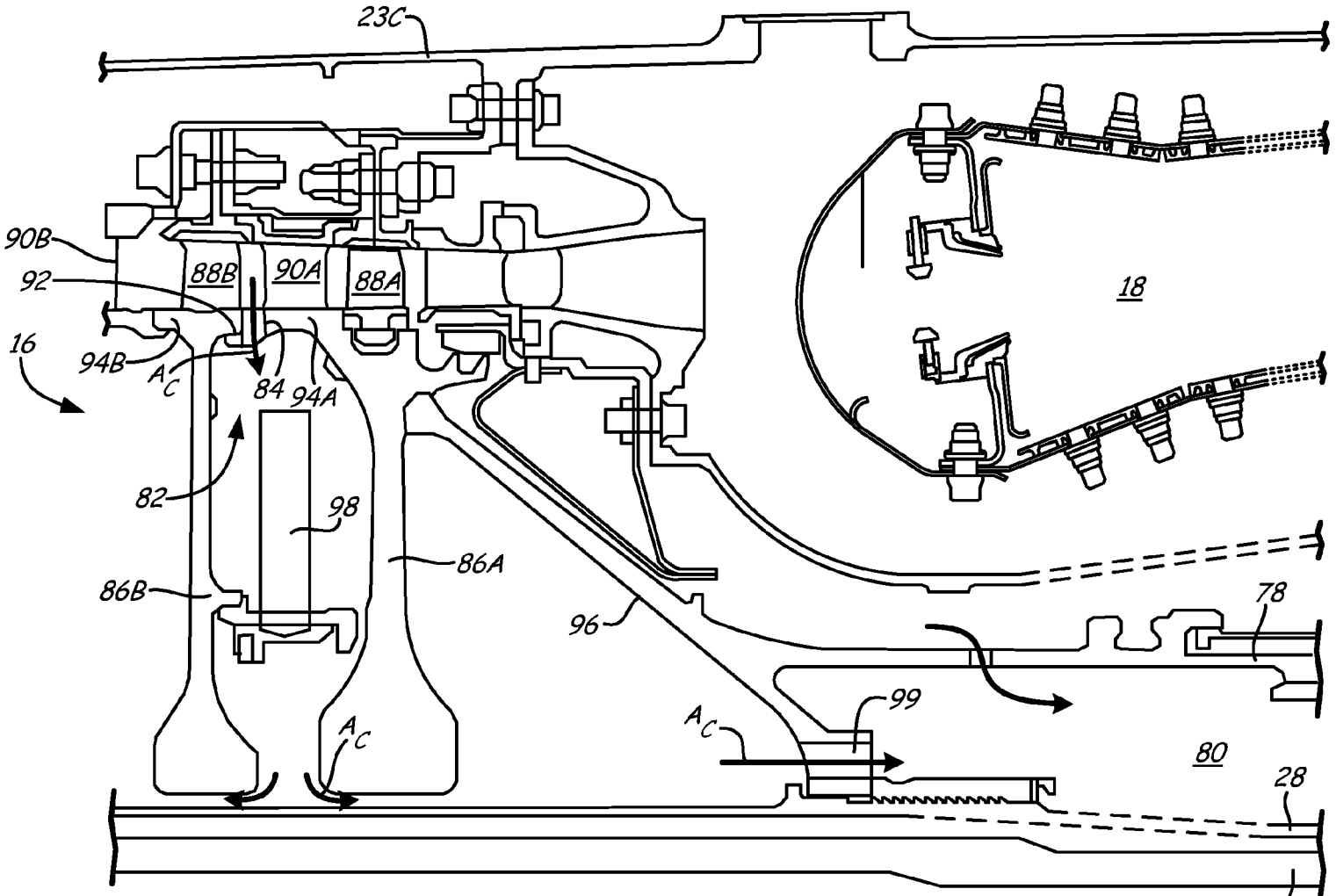
FIG. 3 is a schematic view of the high pressure compressor section of FIG. 1 showing a bleed system having a radially inward-mounted inlet for directing cooling air into a rotating shaft system.

Cooling air $A_C$ is directed radially inward to the interior of HPC 16 between adjacent rotor disks, as shown in FIG. 3. From HPC 16, cooling air $A_C$ is directed along shaft 28 within a tie shaft arrangement (FIG. 3) and passed through inner diameter bores of disks 34A and 34B. Finally, as shown in FIG. 1, cooling air $A_C$ is directed radially outward along the aft face of disk 34B and into blades 32B. Blades 32A are provided with cooling air through a separate coolant circuit that is isolated from the flow of cooling air $A_C$. As such, cooling air $A_C$ can be tailored to the needs of blades 32B. Cooling air $A_C$ can also be used to control the temperature of disk 34B. Furthermore, cooling air $A_C$ is completely contained within rotating components so that dynamic losses are minimized.

Figure 2:
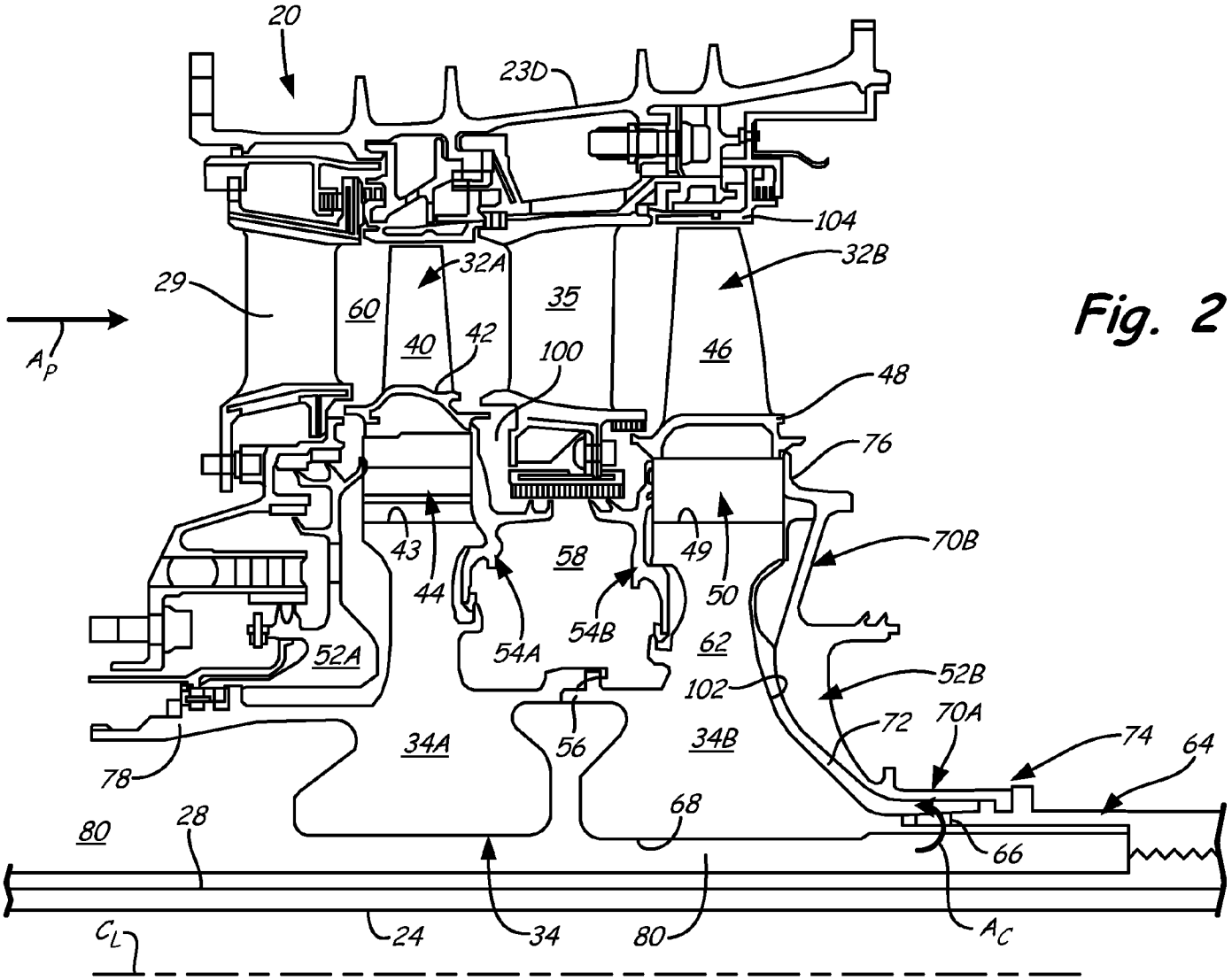
FIG. 2 is a schematic view of the high pressure turbine section of FIG. 1 showing a first stage rotor with a forward-mounted mini-disk and a second stage rotor with an aft-mounted mini-disk.

FIG. 2 shows a schematic view of high pressure turbine, or high pressure turbine section, 20 of gas turbine engine 10 in FIG. 1 having inlet guide vane 29, first stage turbine blade 32A, second stage vane 35 and second stage turbine blade 32B disposed within engine case 23D. Inlet guide vane 29 comprises an airfoil that is suspended from turbine case 23D at its outer diameter end. Turbine blade 32A comprises airfoil 40, which extends radially outward from platform 42. Airfoil 40 and platform 42 are coupled to rotor disk 34A through interaction of rim slot 43 with root 44. Second stage vane 35 comprises an airfoil that is suspended from turbine case 23D at its outer diameter end. Turbine blade 32B comprises airfoil 46, which extends radially outward from platform 48. Airfoil 46 and platform 48 are coupled to rotor disk 34B through interaction of rim slot 49 with root 50.

First stage rotor disk 34A includes forward mini-disk 52A and aft seal plate 54A. Second stage rotor disk 34B includes aft mini-disk 52B and forward seal plate 54B. First stage rotor disk 34A is joined to second stage rotor disk 34B at coupling 56 to define inter-stage cavity 58. Forward mini-disk 52A seals against inlet guide vane 29 and root 44, and directs cooling air (not shown) into rim slot 43. Aft seal plate 54A prevents escape of the cooling air into cavity 58. Aft mini-disk 52B seals against root 50, and directs cooling air $A_C$ into rim slot 49. Forward seal plate 54B prevents escape of cooling air $A_C$ into cavity 58. Aft seal plate 54A and forward seal plate 54B also seal against second stage vane 35 to prevent primary air $A_P$ from entering cavity 58.

Airfoil 40 and airfoil 46 extend from their respective inner diameter platforms toward engine case 23D, across gas path 60. Hot combustion gases of primary air $A_P$ are generated within combustor 18 (FIG. 1) upstream of high pressure turbine 20 and flow through gas path 60. Inlet guide vane 29 turns the flow of primary air $A_P$ to improve incidence on airfoil 40 of turbine blade 32A. As such, airfoil 40 is better able to extract energy from primary air A. Likewise, second stage vane 35 turns the flow of primary air $A_P$ from airfoil 40 to improve incidence on airfoil 46. Primary air $A_P$ impacts airfoils 40 and 46 to cause rotation of rotor disk 34A and rotor disk 34B about centerline $C_L$. Cooling air $A_C$, which is relatively cooler than primary air $A_P$, is routed from high pressure compressor 16 (FIG. 1) to high pressure turbine 20. Specifically, cooling air $A_C$ is provided to rim slot 49 so that the air can enter internal cooling channels of blade 32B without having to pass through any non-rotating components when engine 10 is operating.

Second stage turbine rotor disk 34B of FIG. 1 includes wheel 62 and hub 64, through which holes 66 extend. Wheel 62 includes a plurality of slots 49 that extend through an outer diameter rim of wheel 62. Wheel 62 also includes inner diameter bore 68 through which engine centerline CL extends. First stage turbine rotor disk 34A includes slots 43 and a similar inner diameter bore. Hub 64 extends axially from wheel 62 at inner diameter bore 68 to form an annular body surrounding centerline CL. Rotor disk 34B is also attached to aft mini-disk 52B, which includes axially extending portion 70A and radially extending portion 70B. Mini-disk 52B forms cooling passage 72 along rotor disk 34B. Mini-disk 52B is coupled to hub 64 at joint 74, which comprises a pair of overlapping flanges from hub 64 and axially extending portion 70A. Mini-disk 52B adjoins slots 49 at face seal 76, which comprises a flattened portion that abuts slots 49 and roots 50 of blade 32B.

Rotor disks 34A and 34B, when rotated during operation of engine 10 via high pressure shaft 28, rotate about centerline CL. Low pressure shaft 24 rotates within high pressure shaft 28. Hub 64 of rotor disk 34B is coupled to high pressure shaft 28, which couples to HPC 16 (FIG. 1) through a rotor hub (not shown). Rotor disk 34A is coupled to a rotor hub (FIG. 3) through tie shaft 78 to define cooling passage 80 between tie shaft 78 and high pressure shaft 28. Cooling air $A_C$ from HPC 16 (FIG. 1) is routed into cooling passage 80 where, due to pressure differentials within engine 10, the air turns to enter holes 66. Within holes 66, the air is bent by the rotation of hub 64 and distributed into cooling passage, or plenum, 72. From cooling passage 72, cooling air $A_C$ flows toward face seal 76, which prevents cooling air $A_C$ from escaping rotor disk 34B, and into slots 49. From slots 49 cooling air $A_C$ enters interior cooling channels of blade 32B to cool airfoil 46 relative to primary air $A_P$. As such, cooling air $A_C$ is completely contained within rotating components between high pressure turbine stage 20 and high pressure compressor stage 16, as is explained with reference to FIG. 3.

FIG. 3 is a schematic view of high pressure compressor, or high pressure compressor section, 16 of FIG. 1 showing bleed system 82 having radially inward-mounted inlet 84 for directing cooling air $A_C$ between high pressure shaft 28 and tie shaft 78. High pressure compressor 16 comprises disks 86A and 86B, from which blades 88A and 88B extend. HPC 16 also includes vanes 90A and 90B that extend from HPC case 23C between blades 88A and 88B. Disk 86B is coupled to disk 86A at coupling 92 between rim shrouds 94A and 94B. Disk 86A is coupled to high pressure turbine disk 34A via rotor hub 96 and tie shaft 78. Rotor hub 96 also couples to high pressure shaft 28. High pressure shaft 28 couples second stage high pressure turbine disk 34B to a forward stage (not shown) of HPC 16 in any conventional manner, such as through a rotor hub.

Cooling air $A_C$ flows from between blade 88B and vane 90A radially inward through inlet 84. In the embodiment shown, inlet 84 comprises a bore through rim shroud 94A, but may extend through rim shroud 94B or be positioned between rim shrouds 94A and 94B. Cooling air $A_C$ is directed radially inward through anti-vortex tube 98, which distributes cooling air within the inter-disk space between disks 86A and 86B. From anti-vortex tube 98, cooling air $A_C$ impacts high pressure shaft 28 and is turned axially downstream to passage 99 in rotor hub 96. Portions of cooling air $A_C$ travel upstream to cool other parts of HPC 16. Passage 99 feeds cooling air $A_C$ into cooling passage 80 between tie shaft 78 and high pressure shaft 28. As such, cooling air $A_C$ is completely bounded by components configured to rotate during operation of gas turbine engine 10. In the embodiment shown, cooling air $A_C$ is bounded by rim shroud 94A, rim shroud 94B, disk 86A, disk 86B, rotor hub 96, shaft 28 and a rotor hub (not shown) joining shaft 28 to a disk of HPC 16. For example, a rotor hub having the opposite orientation as rotor hub 96 could extend between shaft 28 and disk 86B, although HPC 16 would typically include many more stages than two. Although the invention has been described with reference to inlet bore 84, in other embodiments other bleed air inlets that siphon air from HPC 16 and direct the air radially inward toward shaft 28 within rotating components may be used, as are known in the art.

As discussed previously with reference to FIG. 2, cooling air $A_C$ continues through cooling passage 80 underneath rotor disks 34A and 34B to flow along inner diameter bores, such as inner diameter bore 68 of rotor disk 34B. From cooling passage 80, cooling air $A_C$ flows through holes 66 into plenum 72 between wheel 62 and aft mini-disk 52B. From plenum 72 cooling air $A_C$ travels into slots 49 and into blade 46. Cooling air $A_C$ is thus completely bounded by components configured to rotate during operation of gas turbine engine 10, before being discharged into gas path 60. In the embodiment shown, cooling air $A_C$ is bounded by tie shaft 78, shaft 28 rotor disk 34A, rotor disk 34B, hub 64, aft-mini disk 52B, forward seal plate 54B and blade 32B.

Because cooling air $A_C$ is bounded by components that rotate when gas turbine engine 10 operates, dynamic losses, such as drag, are avoided, thereby increasing efficiency of HPC 16, reducing the volume of cooling air $A_C$ required for cooling of blades 32B and increasing the overall operating efficiency of engine 10. Furthermore, cooling air $A_C$ is isolated from other flows of cooling air within engine 10, particularly cooling air used to cool HPT front interstage cavity 100. For example, cooling air may be directed from the outer diameter of HPC 16, such as at between the tips of vane 90B and blade 88B (FIG. 3). This cooling air is fed externally through pipes to ports (not shown) in HPT case 23D. This air is used to cool second stage vanes 35 and some portion of this cooling air exits at the inner diameter of the vanes to cool cavity 100. As a result of cooling air $A_C$ being supplied to blades 46 from the backside of disk 62, the need for a full seal that conjoins seal plates 54A and 54B to isolate cavities 100 and 58, as has previously been done in the prior art, is eliminated. Cooling air for cavity 100 is typically required to be at higher pressures than cooling air $A_C$ because primary air $A_P$ must be kept out of inter-stage cavity 100 via pressurization from the cooling air supplied to vanes 35.

A further benefit of the present invention is achieved by the flow of cooling air $A_C$ across bore 68 and aft face 102 of disk 34B. Slots 49 of disk 34B are subject to significantly high temperatures from primary air $A_P$, while bore 68 is subject to less high temperatures due to spacing from primary air A. Thus, a temperature gradient is produced across wheel 62. As temperatures within engine 10 fluctuate due to different operating conditions, the temperature gradient induces low cycle fatigue in wheel 62. Low cycle fatigue from the high temperature gradient reduces the life of disk 34B. The temperature of cooling air $A_C$ can be used to heat bore 68 and aft face 102 of disk 34B to reduce the temperature gradient across wheel 62, while still remaining relatively cooler than primary air $A_P$ to cool blade 32B. A reduction in the temperature gradient across wheel 62 produces a corresponding increase in the life of disk 34B.

Furthermore, bore 68 comprises a large mass of circular material that, when subject to heating, experiences thermal growth that increases the diameter of the circular material. An increase in the diameter of bore 68, and wheel 62, pushes turbine blades 32B radially outward, closer to HPT case 23D. Cooling air $A_C$ can be used to condition the temperature of bore 68 to control the thermal growth rate and change in diameter of the circular material, thereby influencing tip clearance between airfoil 46 of blade 32B and shroud 104 attached to HPT case 23D.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

Discussion of Possible Embodiments

The following are non-exclusive descriptions of possible embodiments of the present invention.

A turbine stage for a gas turbine engine is configured to rotate in a circumferential direction about an axis extending through a center of the gas turbine engine. The turbine stage comprises: a disk comprising: an outer diameter edge having slots, an inner diameter bore surrounding the axis, a forward face, and an aft face; a plurality of blades coupled to the slots; and a mini-disk coupled to the aft face of the disk to define a cooling plenum therebetween to direct cooling air to the slots.

The turbine stage of the preceding paragraph can optionally include, additionally and/or alternatively, any one or more of the following features, configurations and/or additional components:

a hub extending from the inner diameter bore of the disk to form an annular body, and a plurality of holes extending through the hub to permit cooling air from within the hub to enter the cooling plenum;

an axially extending portion disposed opposite the hub, and a radially extending portion disposed opposite the aft face of the disk;

a cover plate coupled to the forward face of the disk across the slots;

an axial retention flange disposed at a radial distal tip of the radially extending portion to engage the slots, and a coupling disposed at an axially distal tip of the axially extending portion to engage the hub;

a shaft extending from the hub through the inner diameter bore to define a cooling passage fluidly coupled to the holes and the plenum;

a first stage turbine rotor coupled to the forward face of the disk to define an inter-stage cavity between the first stage turbine rotor and the disk, and a first stage mini-disk coupled to a forward-facing side of the first stage turbine rotor;

a compressor stage, a shaft coupling the compressor stage to the hub of the turbine stage, the shaft passing through the inner diameter bore, and a bleed air inlet for directing cooling air from the compressor to a space radially outward of the shaft;

a first compressor rotor having a plurality of compressor blades extending from a first rim, and a second compressor rotor having a plurality of compressor blades extending from a second rim, the second compressor rotor coupled to the first compressor rotor, wherein the bleed air inlet extends radially inward between the first and second rims;

a compressor rotor hub connecting the second compressor rotor to the shaft, and a tie shaft coupling the compressor rotor hub to the first stage turbine rotor.

A gas turbine engine comprises a compressor section including a bleed inlet for siphoning cooling air from the compressor section; a turbine section comprising: a rotor comprising: an inner diameter bore, an outer diameter rim, a forward face, and an aft face; a shaft coupled to the compressor section and the turbine section; a plurality of blades coupled to the rotor; a mini-disk coupled to the aft face of the rotor to define a plenum; and a cooling circuit fluidly coupling the bleed inlet of the compressor section to the plenum, the cooling circuit extending along the shaft and the aft face of the rotor.

The gas turbine engine of the preceding paragraph can optionally include, additionally and/or alternatively, any one or more of the following features, configurations and/or additional components:

the rotor further comprises a hub extending from the aft face, and the shaft extends through the inner diameter bore to join to the hub;

a plurality of holes in the hub to fluidly connect the cooling circuit with the plenum;

the compressor section further comprises a rotor hub, and the shaft comprises a tie shaft extending between the rotor hub and the turbine section;

a first compressor rotor having a plurality of compressor blades extending from a first rim, and a second compressor rotor having a plurality of compressor blades extending from a second rim, the second compressor rotor coupled to the first compressor rotor, wherein the bleed air inlet that extends radially inward between the first and second rims; and the cooling circuit is completely defined by components configured to rotate during operation of the gas turbine engine.

A method of providing compressor bleed air to a turbine stage of a gas turbine engine comprises: flowing the bleed air axially along a shaft connecting a compressor stage to a turbine stage; passing the bleed air through bore of a rotor disk of the turbine stage; directing the bleed air radially along an aft surface of the rotor disk; and feeding the bleed air into a blade slot in a rim of the rotor disk.

The method of the preceding paragraph can optionally include, additionally and/or alternatively, any one or more of the following features, configurations and/or additional steps:

the step of heating the bore of the rotor disk with the compressor bleed air to reduce a temperature gradient between the rim and the bore;

the step of controlling thermal growth of the rotor disk with the compressor bleed air to influence blade tip clearance;

the step of originating the bleed air from a rim of the compressor stage, and the step of routing the bleed air radially inward to the shaft;

the bleed air is bounded from the compressor stage to the turbine stage by components of the gas turbine engine configured to rotate; and the bleed air bypasses an inter-stage cavity defined by adjacent rotor disk in the turbine stage.

The invention claimed is:

1. A turbine stage for a gas turbine engine configured to rotate in a circumferential direction about an axis extending through a center of the gas turbine engine, the turbine stage comprising:

a turbine disk comprising:

an outer diameter edge having slots;

an inner diameter bore surrounding the axis;

a forward face;

an aft face;

a hub extending from the inner diameter bore of the turbine disk to form an annular body; and a plurality of holes extending through the hub;

a plurality of blades coupled to the slots;

a mini-disk comprising:

an axially extending portion disposed opposite the hub;

a radially extending portion disposed opposite the aft face of the turbine disk;

an axial retention flange disposed at a radial distal tip of the radially extending portion to engage the slots; and a coupling disposed at an axially distal tip of the axially extending portion to engage the hub, wherein the mini-disk couples to the aft face of the turbine disk to define a cooling plenum therebetween to direct cooling air to the slots, and wherein the holes permit cooling air from within the hub to enter the cooling plenum; and a shaft extending from the hub through the inner diameter bore coupling the turbine disk to a compressor disk, wherein the inner diameter bore and the shaft define a cooling passage fluidly coupled to the holes and the plenum.

2. The turbine stage of claim 1 and further comprising:

a cover plate coupled to the forward face of the turbine disk across the slots.

3. The turbine stage of claim 1 and further comprising:

a first stage turbine rotor coupled to the forward face of the turbine disk to define an inter-stage cavity between the first stage turbine rotor and the turbine disk; and a first stage mini-disk coupled to a forward-facing side of the first stage turbine rotor.

4. A gas turbine engine incorporating the turbine stage of claim 3, the gas turbine engine further comprising:

a compressor stage; and a bleed air inlet for directing cooling air from the compressor to the cooling passage, wherein the cooling passage is radially outward of the shaft, wherein the shaft couples the compressor stage to the hub of the turbine stage.

5. The gas turbine engine of claim 4 wherein the compressor stage comprises:

a first compressor rotor having a plurality of compressor blades extending from a first rim; and a second compressor rotor having a plurality of compressor blades extending from a second rim, the second compressor rotor coupled to the first compressor rotor;

wherein the bleed air inlet extends radially inward between the first and second rims.

6. The gas turbine engine of claim 5 and further comprising:

a compressor rotor hub connecting the second compressor rotor to the shaft; and a tie shaft coupling the compressor rotor hub to the first stage turbine rotor.

7. A gas turbine engine comprising:

a compressor section including a bleed inlet for siphoning cooling air from the compressor section;

a turbine section comprising:

a rotor comprising:

an inner diameter bore;

an outer diameter rim;

a forward face;

an aft face;

a hub extending from the aft face; and a first flange extending radially from the hub;

a shaft coupled to the compressor section and the turbine section, wherein the shaft extends through the inner diameter bore to join to the hub;

a plurality of blades coupled to the rotor;

a mini-disk comprising:

an axially extending portion disposed opposite the hub; and a second flange disposed at an axially distal tip of the axially extending portion to engage the first flange, wherein the mini-disk couples to the aft face of the rotor to define a plenum; and a cooling circuit fluidly coupling the bleed inlet of the compressor section to the plenum, the cooling circuit extending along the shaft and the aft face of the rotor, wherein a portion of the cooling circuit is defined by the inner diameter bore and the shaft.

8. The gas turbine engine of claim 7 and further comprising:

a plurality of holes in the hub to fluidly connect the cooling circuit with the plenum.

9. The gas turbine engine of claim 7 wherein:

the compressor section further comprises a rotor hub; and the shaft comprises a tie shaft extending between the rotor hub and the turbine section.

10. The gas turbine engine of claim 7 wherein the compressor section further comprises:

a first compressor rotor having a plurality of compressor blades extending from a first rim; and a second compressor rotor having a plurality of compressor blades extending from a second rim, the second compressor rotor coupled to the first compressor rotor;

wherein the bleed air inlet extends radially inward between the first and second rims.

11. The gas turbine engine of claim 7 wherein cooling circuit is completely defined by components configured to rotate during operation of the gas turbine engine.

12. A method of providing compressor bleed air to a turbine stage of a gas turbine engine, the method comprising:

flowing the bleed air axially along a shaft connecting a compressor stage to a turbine stage, wherein an inner diameter bore of a rotor disk and the shaft define a cavity;

passing the bleed air through the cavity;

directing the bleed air radially along an aft surface of the rotor disk; and feeding the bleed air into a blade slot in a rim of the rotor disk.

13. The method of claim 12 and further comprising:

heating the bore of the rotor disk with the compressor bleed air to reduce a temperature gradient between the rim and the bore.

14. The method of claim 12 and further comprising:

controlling thermal growth of the rotor disk with the compressor bleed air to influence blade tip clearance.

15. The method of claim 12 and further comprising:

originating the bleed air from a rim of the compressor stage; and routing the bleed air radially inward to the shaft.

16. The method of claim 15 wherein the bleed air is bounded from the compressor stage to the turbine stage by components of the gas turbine engine configured to rotate.

17. The method of claim 12 wherein the bleed air bypasses an inter-stage cavity defined by adjacent rotor disk in the turbine stage.

* * * * *